US010136224B2

(12) United States Patent
Epping

(10) Patent No.: US 10,136,224 B2
(45) Date of Patent: Nov. 20, 2018

(54) ELECTRODYNAMIC SOUND TRANSDUCER

(71) Applicant: Sennheiser electronic GmbH & Co. KG, Wedemark (DE)

(72) Inventor: Heinz Epping, Hildesheim (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 15/466,538

(22) Filed: Mar. 22, 2017

(65) Prior Publication Data

US 2017/0257704 A1 Sep. 7, 2017

Related U.S. Application Data

(63) Continuation of application No. PCT/EP2015/072226, filed on Sep. 28, 2015.

(51) Int. Cl.

| | |
|---|---|
| ***H04R 7/16*** | (2006.01) |
| ***H04R 7/12*** | (2006.01) |
| ***H04R 7/20*** | (2006.01) |
| ***H04R 9/06*** | (2006.01) |
| ***H04R 9/08*** | (2006.01) |
| ***H04R 31/00*** | (2006.01) |
| *H04R 7/04* | (2006.01) |

(52) U.S. Cl.

CPC ..... *H04R 7/16* (2013.01); *H04R 7/127* (2013.01); *H04R 7/20* (2013.01); *H04R 9/06* (2013.01); *H04R 9/08* (2013.01); *H04R 31/003* (2013.01); *H04R 7/04* (2013.01); *H04R 2231/003* (2013.01); *H04R 2400/11* (2013.01)

(58) Field of Classification Search

CPC . H04R 7/127; H04R 7/16; H04R 7/18; H04R 7/20; H04R 7/22; H04R 9/045; H04R 9/06; H04R 9/08; H04R 31/00; H04R 31/003; H04R 31/006; H04R 2207/021; H04R 2307/207; H04R 2400/11

See application file for complete search history.

(56) References Cited

U.S. PATENT DOCUMENTS

| | | | |
|---|---|---|---|
| 1,514,511 | A | 11/1924 | Fischer |
| 8,542,861 | B2 | 9/2013 | Saiki et al. |

(Continued)

FOREIGN PATENT DOCUMENTS

| | | | |
|---|---|---|---|
| DE | 503 827 | A2 | 7/1930 |
| DE | 44 97 415 | B4 | 1/2005 |

(Continued)

OTHER PUBLICATIONS

International Search Report dated Oct. 22, 2015 for PCT/EP2015/072226, 5 pages, (Non-English).

(Continued)

*Primary Examiner* — Joshua Kaufman

(74) *Attorney, Agent, or Firm* — Kilpatrick Townsend & Stockton LLP

(57) ABSTRACT

There is provided an electrodynamic sound transducer comprising a chassis and at least one diaphragm which is capable of vibrating and which at its edge has at least two oppositely disposed fixing portions for fixing the diaphragm to the chassis. The edge of the diaphragm is not connected to the chassis between the fixing portions so that the diaphragm can vibrate freely at those locations.

14 Claims, 10 Drawing Sheets

(56) References Cited

U.S. PATENT DOCUMENTS

| | | | | |
|---|---|---|---|---|
| 2003/0079936 | A1* | 5/2003 | Kuze | H04R 9/043 181/171 |
| 2009/0052726 | A1 | 2/2009 | Hatanaka | |
| 2011/0044489 | A1* | 2/2011 | Saiki | H04R 7/20 381/388 |
| 2011/0211725 | A1* | 9/2011 | Takewa | H04R 7/04 381/413 |
| 2011/0235849 | A1 | 9/2011 | Takewa | |
| 2014/0153750 | A1 | 6/2014 | Konno et al. | |
| 2014/0205135 | A1 | 7/2014 | Sakaguchi et al. | |
| 2014/0241565 | A1* | 8/2014 | Jin | H04R 7/04 381/388 |

FOREIGN PATENT DOCUMENTS

| | | | |
|---|---|---|---|
| DE | 10 2008 059 312 | A1 | 6/2010 |
| EP | 0 678 853 | A2 | 10/1995 |
| EP | 0 678 853 | A3 | 5/1997 |
| EP | 0 772 373 | A2 | 5/1997 |
| EP | 1 694 094 | A1 | 8/2006 |
| JP | 2004120517 | A | 4/2004 |
| WO | 2006/038176 | A1 | 4/2006 |
| WO | 2016/046412 | A1 | 3/2016 |

OTHER PUBLICATIONS

Written Opinion dated Oct. 22, 2015 for PCT/EP2015/072226, 9 pages (Non-English.).

First Notice Informing the Applicant of the Communication of the International Application (to Designated Offices which do not Apply the 30 Month Time Limit Under Article 22(1)) dated Apr. 28, 2016 for PCT/EP2015/072226 , 1 page.

Second and Supplementary Notice Informing the Applicant of the Communication of the International Application (to Designated Offices which Apply the 30 Month Time Limit Under Article 22(1)) dated Jan. 26, 2017 for PCT/EP2015/072226, 1 page.

Notification of Receipt of Record dated Oct. 8, 2015 for PCT/EP2015/072226, 1 page.

Notification Concerning Availability of the Publication of the International Application dated Mar. 31, 2016 for PCT/EP2015/072226, 1 page.

* cited by examiner

ELECTRODYNAMIC SOUND TRANSDUCER

CROSS-REFERENCE TO RELATED APPLICATIONS

The present application is a continuation of PCT Application No. PCT/EP2015/072226, filed Sep. 28, 2015, which claims priority to German Application No. 102014219630.2, filed Sep. 26, 2014, the disclosures of which being hereby incorporated by reference in their entirety for all purposes.

BACKGROUND

Electrodynamic sound transducers have long been known and have a diaphragm which is capable of vibrating and to which a vibrating coil is coupled, and a magnet system. Electrodynamic sound transducers can be used as microphones or reproduction transducers. The diaphragms of the electrodynamic sound transducers are typically round and have an annular vibrating coil which is coupled to the diaphragm and thus can vibrate together with the diaphragm.

The outer edge of the diaphragm is typically coupled to a housing or chassis of the reproduction transducer so that this provides a circular diaphragm capable of vibrating.

On the German patent application from which priority is claimed the German Patent and Trade Mark Office cited the following documents: US 2010/0235849 A1, U.S. Pat. No. 8,542,861 B2, US 2014/0205135 A1, US 2014/0153750 A1, WO 2006/038176 A1, DE 10 2008 059 312 A1, JP 2004-120517 A, DE 503 827 A and EP 0 772 373 A2.

SUMMARY

An object of the present invention is to provide an electrodynamic sound transducer which has an improved wide-band transmission characteristic.

That object may be attained by an electroacoustic sound transducer as set forth in the claims and by a method of producing an electrodynamic sound transducer as set forth in the claims.

Thus, there is provided an electrodynamic sound transducer comprising a chassis and at least one diaphragm capable of vibrating. At its edge the diaphragm which is capable of vibrating has at least two mutually opposite fixing portions for fixing the diaphragm to the chassis. The fixing portions can be in the shape of a segment of a circle. Between the fixing portions the edge of the diaphragm is not connected to the chassis so that the diaphragm can vibrate freely at those locations. The diaphragm further has a central portion directly between the two fixing portions, that can be of a rectangular configuration.

The two fixing portions 110 in the shape of a segment of a circle are defined by a circle which has a diameter 100*b*, a central point M and a circle-bisecting straight line 100*a*. The central portion 130 has two straight lines 105 arranged parallel to the circle-bisecting straight line 100*a*.

The diaphragm is thus preferably of a stadium-shaped form. In other words, it is possible to obtain a structure for the diaphragm by two segments of a circle being cut from or out of a circular diaphragm. In that way, the length of the diaphragm is greater than the width thereof. In that case the diaphragm is delimited at its edge by two oppositely disposed ends which can vibrate freely with respect to the chassis, and by two oppositely disposed ends in the shape of a segment of a circle. The ends in the form of a segment of a circle serve as fixing portions, that is to say the diaphragm is fixed to the chassis of the electrodynamic sound transducer by way of the fixing portions which are in the shape of segments of a circle. Thus, the central rectangular portion between the two fixing portions is not fixed to the chassis and can thus vibrate freely.

A circular vibrating coil can be fixed to the diaphragm and can vibrate with the diaphragm. The electrodynamic sound transducer can also have a magnet system which can cooperate with the vibrating coil. Optionally, the diaphragm can be of an embossed design.

According to certain embodiments, a segment of a circle is a part of a circular surface that is defined by a circular arc and a chord of the circle.

Optionally, the diaphragm can have at least one bead and a central dome region. The diaphragm can move freely at its longitudinal sides, that is to say the straight sides, so that there is no contact between the chassis and the central portion of the diaphragm.

According to certain embodiments, there can be provided damping units which are adapted to the shape of the diaphragm.

Aspects of the invention also concern a method of producing an electrodynamic transducer. In that case, the electrodynamic transducer has a stadium-shaped diaphragm. That diaphragm is produced from a circular diaphragm, wherein two oppositely disposed circle portions are cut away or cut off. That gives a diaphragm which has two ends in the form of a segment of a circle and two parallel straight portions. The two parallel straight portions are parallel to a straight line through the central point of the circular diaphragm (that is to say parallel to the circle bisector). That therefore gives a shape which reminds us of a 400 meter running track and hence the term stadium-shaped.

Further configurations of the invention are subject-matter of the appendant claims.

Advantages and embodiments, by way of example, are described in greater detail hereinafter with reference to the drawings.

DETAILED DESCRIPTION

The present invention concerns an electrodynamic sound transducer and a method of producing an electrodynamic sound transducer.

Figure 1A:
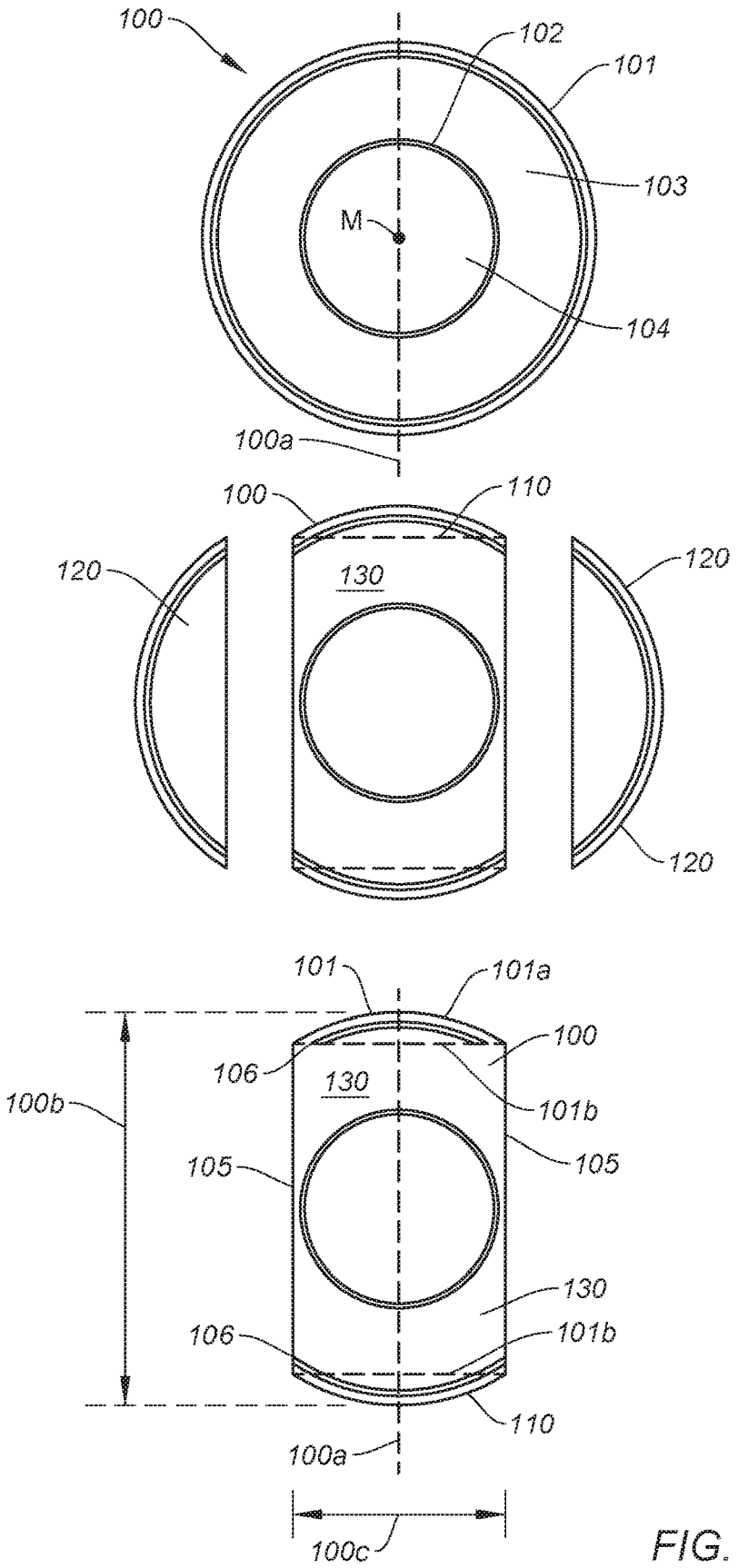
FIG. 1A-1C each show various diagrammatic views of a diaphragm according to the invention for an electrodynamic transducer according to a first embodiment.
Figure 1B:
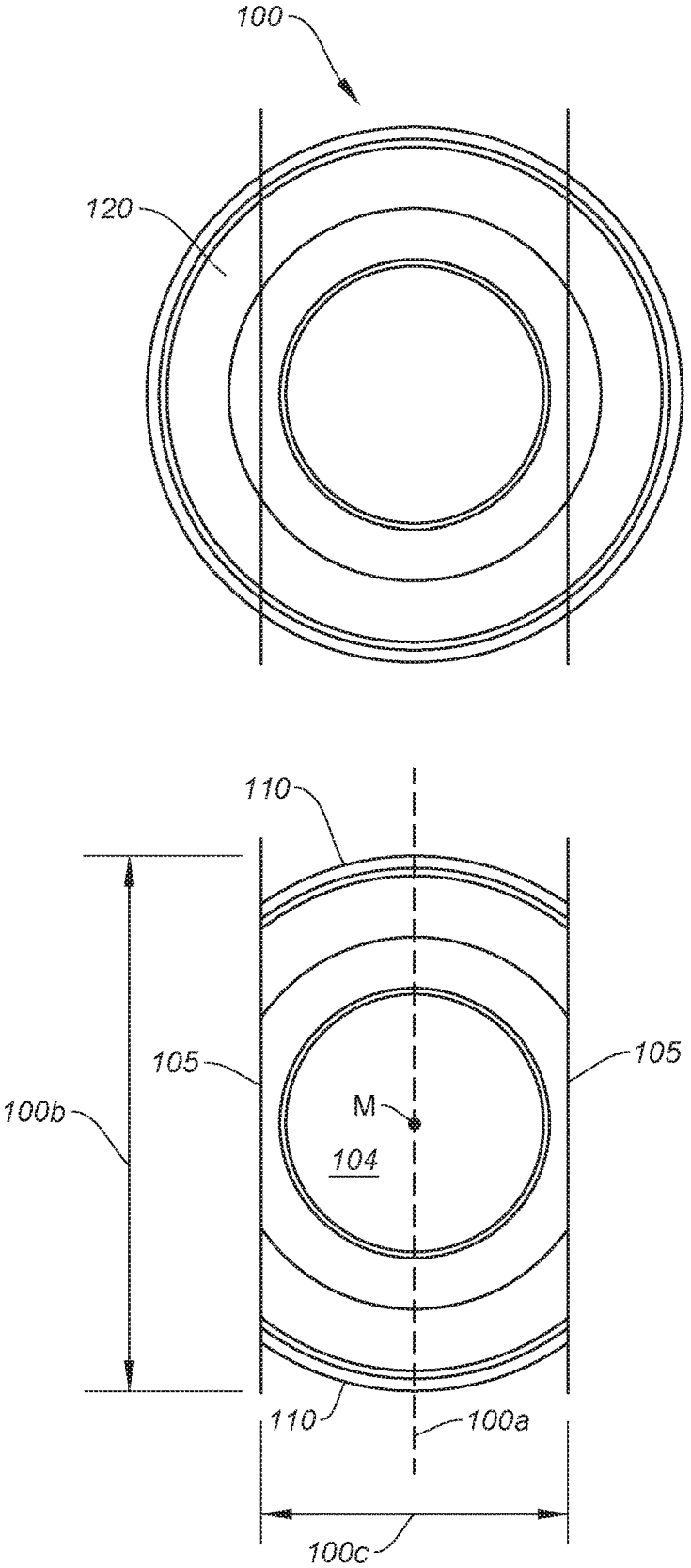
Figure 1C:
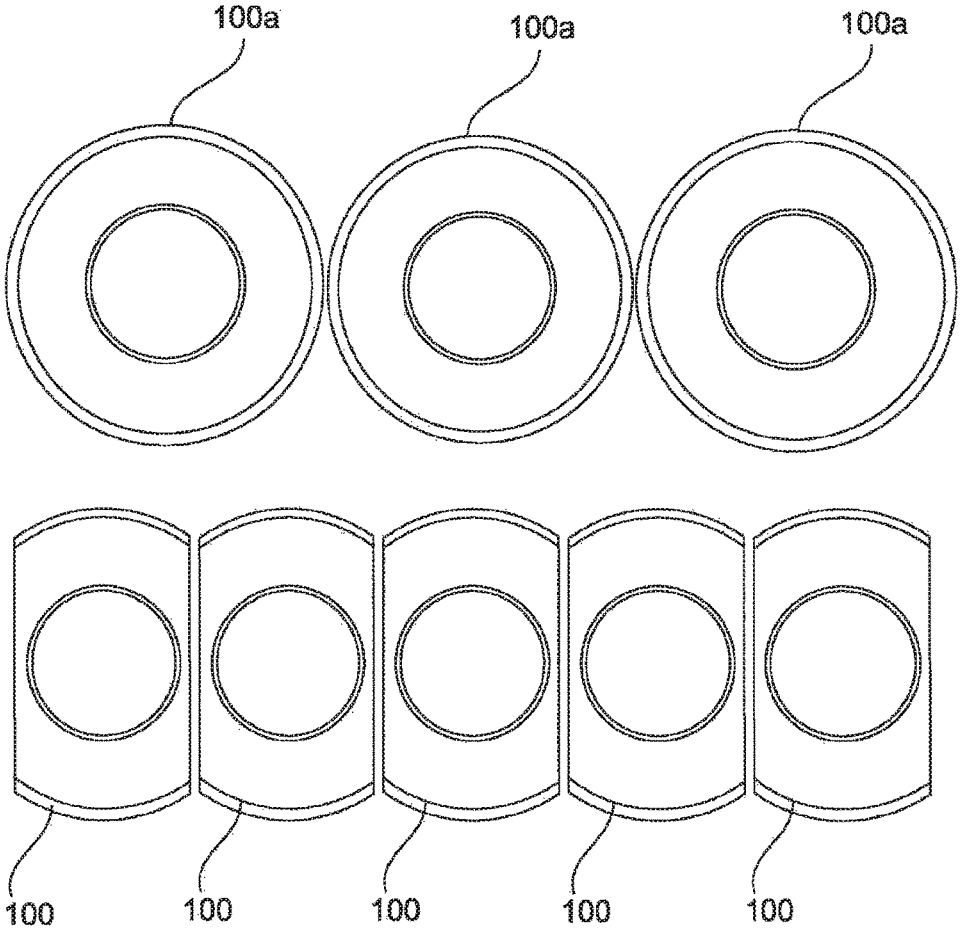

FIGS. 1A-1C each show different diagrammatic views of a diaphragm according to the invention for an electrodynamic transducer according to a first embodiment. FIG. 1A is a plan view of a diaphragm according to the invention. In particular FIG. 1A diagrammatically shows the steps for production of the diaphragm according to the invention. The diaphragm 100 according to the invention is originally a conventional circular diaphragm 100 of a radius r, having a central point M and a straight line 100*a* through the central point M (that is to say a circle bisector). Two segments of a circle 120 are then cut off or out so that two sides of the diaphragm now represent a straight line 105. According to the invention a segment of a circle is a part of a circular area which is defined by a circular arc and a chord of the circle.

The two straight lines 105 are parallel to the circle-bisecting straight line 100*a*. The diaphragm 100 is of a length 100*b* which corresponds to the diameter of the diaphragm 100. After the two circle segments 120 have been removed the diaphragm 100 is of a width 100*c* which is less than the length 100*b* or the diameter of the originally circular diaphragm 100. The straight portions 105 of the (originally circular) diaphragm 100 are parallel to the circle-bisecting straight line 100*a* which extends through the central point M of the (originally circular) diaphragm.

According to aspects of the invention therefore it is possible to provide a diaphragm which is of a stadium-shaped form. The diaphragm 100 has two portions 110 in the shape of a segment of a circle and a central portion 130 therebetween, that is rectangular. The two portions 110 in the form of a segment of a circle are defined by a circular arc 101*a* and a chord 101*b*. The central portion 130 is defined by the chords 101*b* and the straight lines 105 which extend between the chords 101*b*. The straight lines 105 are parallel to the circle-bisecting straight line 100*a*. According to aspects of the invention, the diaphragm is fixed by means of the portions 110 in the shape of a segment of a circle in or to an electrodynamic reproduction transducer and in particular a chassis of the transducer. In that way, the circle segments 110 serve as fixing portions 110. The central rectangular portion 130 is not fixed to the chassis or a housing of the transducer and can thus vibrate freely. The diaphragm 100 can have a bead 103 and a dome 104. The diaphragm can further have a portion 102 (that is to say a coil seat) for fixing an annular coil.

In the case of the diaphragm, according to the first embodiment, flexibility of the diaphragm is afforded by a bead 103 of the diaphragm. The region of the dome 104 is preferably a central region and the dome region is at least portion-wise of a spherical configuration. The dome region can also be reinforced by the coil seat and the vibrating coil. As the longitudinal sides or straight edges 105 of the diaphragm are not fixed to the chassis the diaphragm can vibrate freely there.

The diaphragm 100 is fixed to a chassis of the transducer at the two portions 110 in the shape of a segment of a circle.

The design configuration according to the invention of the diaphragm makes it possible to achieve a drastic reduction in resonance frequency. The diaphragm, according to aspects of the invention as set forth by the first embodiment, has a markedly lower fundamental resonance frequency than a conventional diaphragm as shown in the upper part of FIG. 1A. The diaphragm shown above in FIG. 1A can have, for example, a fundamental frequency at 557 Hz while the fundamental frequency of the diaphragm according to the invention is at 369 Hz. In this example, therefore, the diaphragm according to the invention can permit a reduction in fundamental frequency to 67%. In addition, the diaphragm according to the invention is advantageous in regard to the wobble modes. While the diaphragm shown in the upper part of FIG. 1A has a wobble mode at 878 Hz and 879 Hz, the diaphragm, according to aspects of the invention, has a wobble mode at 423 Hz and at 764 Hz. While the two above-mentioned wobble modes are really close together in the diaphragm, according to the state of the art, the two wobble modes with the diaphragm, according to aspects of the invention, are further apart, thereby giving a lesser wobble tendency overall.

As can be seen from FIG. 1B, the ratio of the effective area to the total area of the diaphragm in the case of the diaphragm, according to aspects of the invention, is greater than in the case of a conventional diaphragm (upper diaphragm in FIG. 1B). The moved mass of the diaphragm is also reduced by the configuration according to the invention, to the same extent as the total area.

FIG. 1C in the top part thereof shows three conventional diaphragms 100*a* one beside the other while the bottom part shows five diaphragms 100, according to aspects of the invention. By virtue of the fact that the width 100*c* of the diaphragms according to the invention is less than the length 100*b* of the diaphragms (that is to say the diameter), more diaphragms can be disposed on the same width. Accordingly, the effective area of the diaphragms is greater in relation to the structural space available.

Figure 2A:
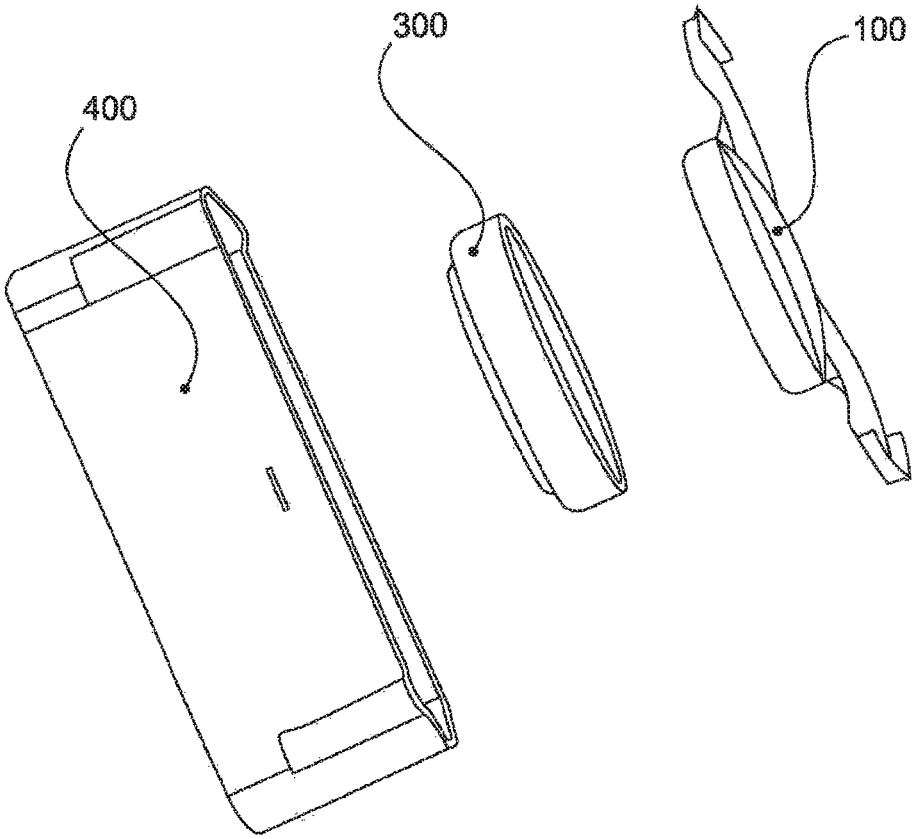
FIG. 2A-2D each show a diagrammatic view of an electrodynamic transducer according to a second embodiment.

FIGS. 2A-2D show various views of an electrodynamic transducer according to a second embodiment. FIG. 2A shows an exploded view of the electrodynamic transducer according to the invention. In this case, a diaphragm 100, a magnet system 300 and a chassis 400 are shown. The diaphragm 100, according to the second embodiment, can correspond to the diaphragm according to the first embodiment or can also be based on that diaphragm 100. According to the second embodiment, a vibrating coil 500 is fixed to the diaphragm 100.

Figure 2B:
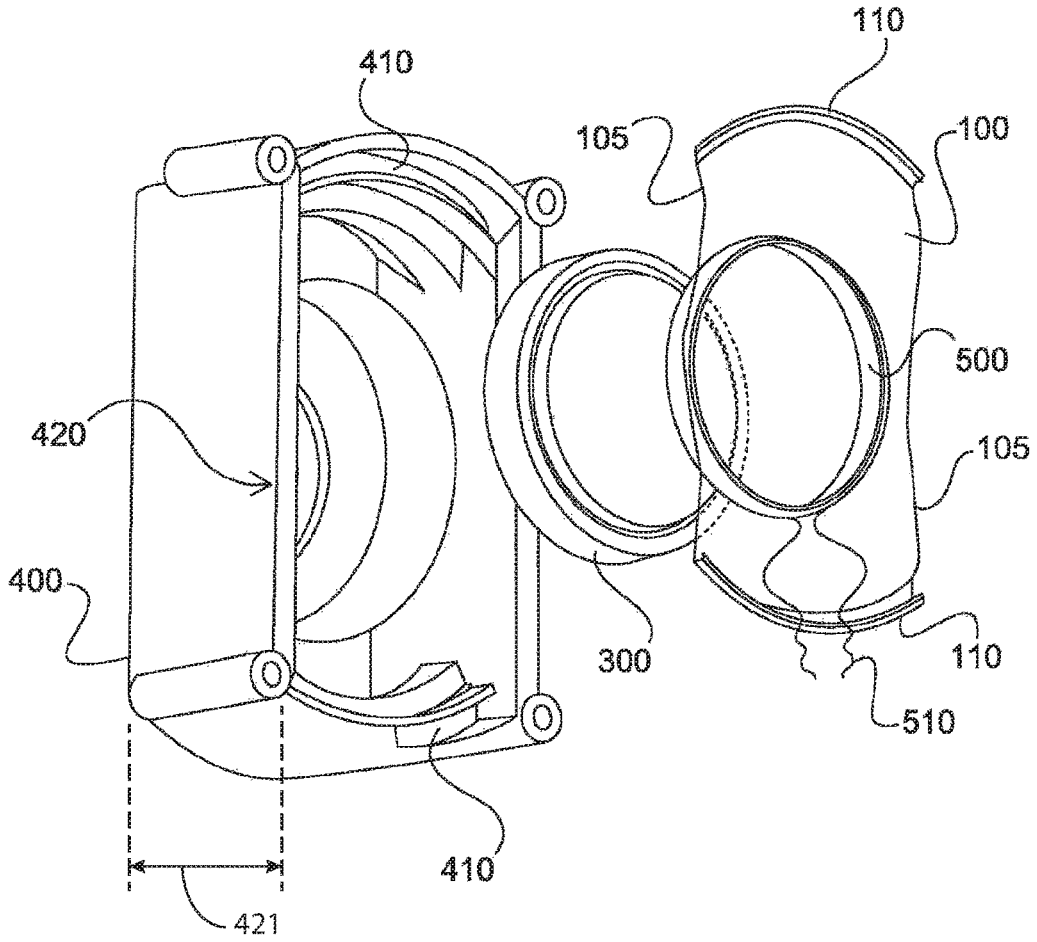

FIG. 2B shows a further view of the electrodynamic transducer, according to aspects of the invention. The diaphragm 100 has two fixing portions 110 in the shape of a segment of a circle and two straight sides or portions 105. The vibrating coil 500 with the feed lines 510 is fixed to the diaphragm 100. The magnet system 300 is fitted into the chassis 400 and then the diaphragm 100 is fixed with the fixing portions 110 in the shape of a segment of a circle to a fixing portion 410 of the chassis 400 so that the vibrating coil 500 is arranged in the magnet system 300. The chassis 400 is equipped with two side walls 420 which in their shape correspond to the freely vibrating edge portions 105 of the diaphragm, that is to say the two side walls 420 are straight.

Figure 2C:
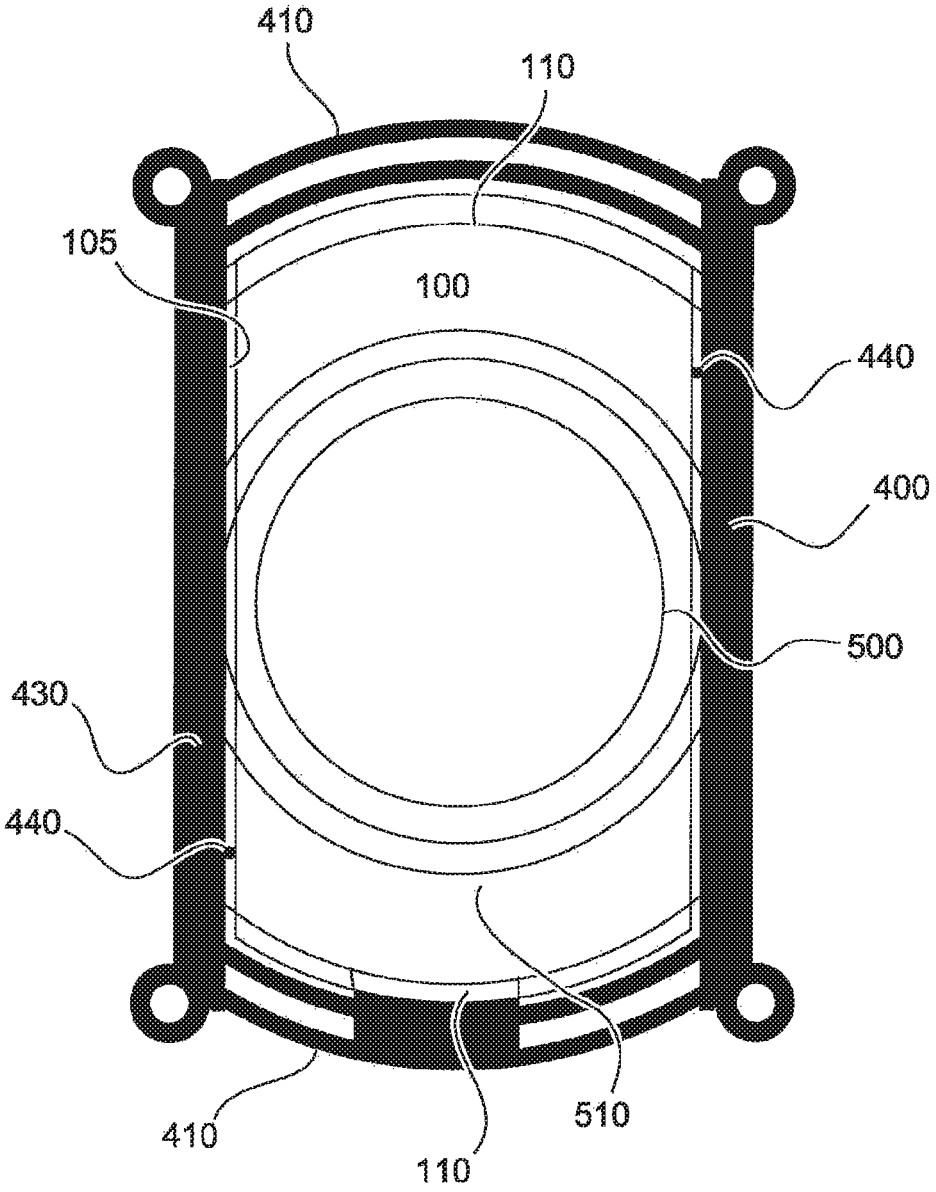

FIG. 2C shows a plan view of the electrodynamic sound transducer in accordance with the second embodiment. In this case, there is a gap 440 between the straight portions 105 of the diaphragm and the straight portions 420 of the chassis 400 so that the diaphragm 100 does not touch the chassis 400. The side walls 420 are of a height 421. In the installed condition of the diaphragm 100 (that is to say when the fixing portions 110 of the diaphragm are fixed to the fixing portions 410 of the chassis 400) the side wall 420 projects both upwardly and also downwardly beyond the diaphragm. Accordingly, the side wall 420 is higher than the diaphragm 100. The side walls 420 are of such a configuration that the gap 440 retains its size upon the deflections which occur in operation. In that respect, the gap 440 is selected to be as small as possible to avoid an acoustic short-circuit in which the air could pass from the front side of the diaphragm to the rear side of the diaphragm through the gap 440. Because the side walls 420 project beyond the diaphragm 100, that is to say because the side walls 420 are higher than the diaphragm 100, it is possible to better avoid an acoustic short-circuit. The side walls 420 are both straight and also perpendicular. The width of the gap is for that purpose preferably less than 10% of the diameter of the coil 500.

Figure 2D:
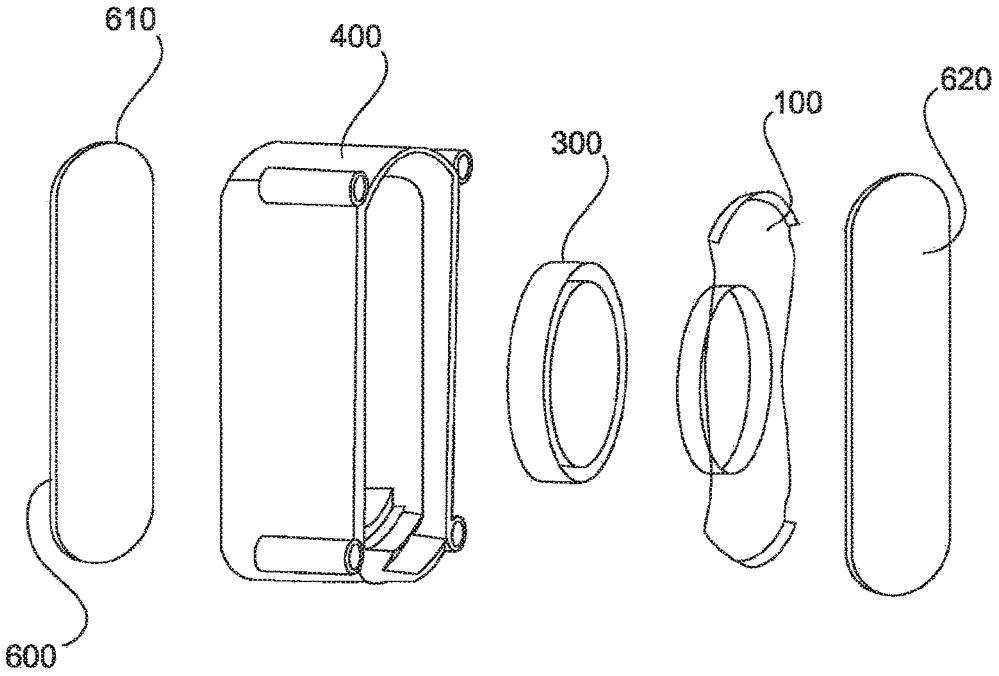

In FIG. 2D there are two additional damping units 610, 620 which can be arranged on the top side and the underside of the chassis to be able to provide an acoustic damping effect. The shape of the damping units 610, 620 is adapted to the shape of the diaphragm 100.

Figure 3:
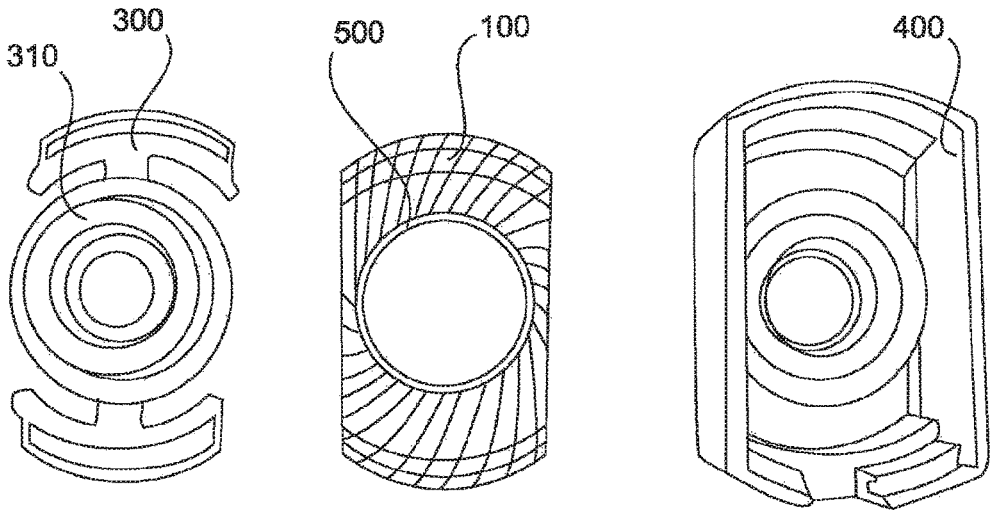
FIG. 3 shows a diagrammatic illustration of an electrodynamic sound transducer according to a third embodiment.

FIG. 3 shows a diagrammatic illustration of an electrodynamic sound transducer, according to a third embodiment. The electroacoustic transducer, according to the third embodiment, has a stadium-shaped diaphragm 100, a magnet system 300 and a chassis 400 which are adapted to the stadium shape of the diaphragm. According to aspects of the invention, the magnet system 300 can have two axially magnetized rings 310. The coil 500 can be placed in the gap between the two rings.

Figure 4A:
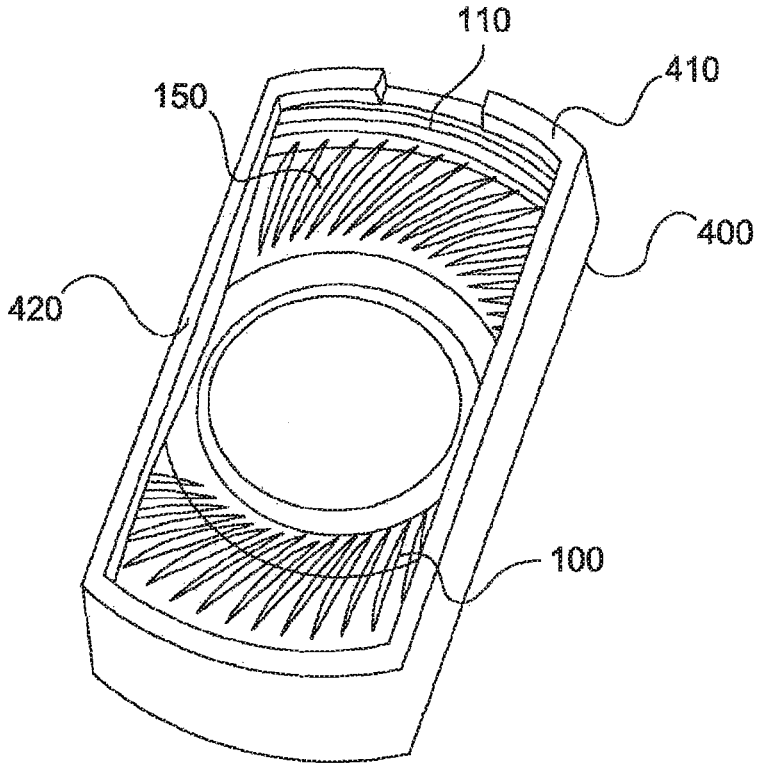
FIGS. 4A and 4B show different views of an electrodynamic sound transducer according to a further embodiment of the invention.
Figure 4B:
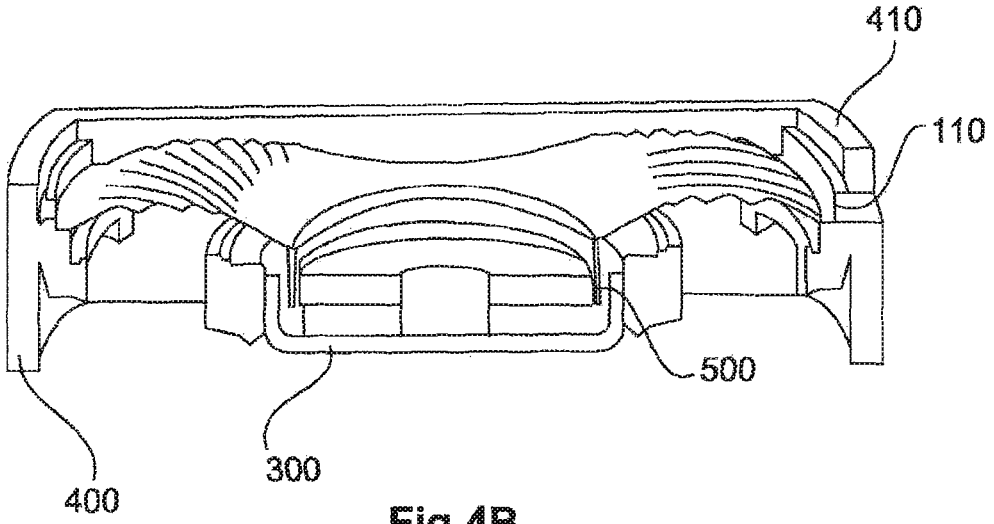

FIGS. 4A and 4B show different views of an electrodynamic sound transducer, according to further embodiments of the invention. FIG. 4 shows an electrodynamic transducer, according to a fourth embodiment. The transducer has a chassis 400 with two portions 410 in the shape of a segment of a circle and two straight portions 420. The diaphragm 100 has two portions 110 in the shape of a segment of a circle and a rectangular portion therebetween with two straight sides 105.

FIG. 4B shows a diagrammatic sectional view. According to the fourth embodiment, the diaphragm can have pronounced shaped portions 150. The coil can be for example in the form of a copper coil.

Figure 5:
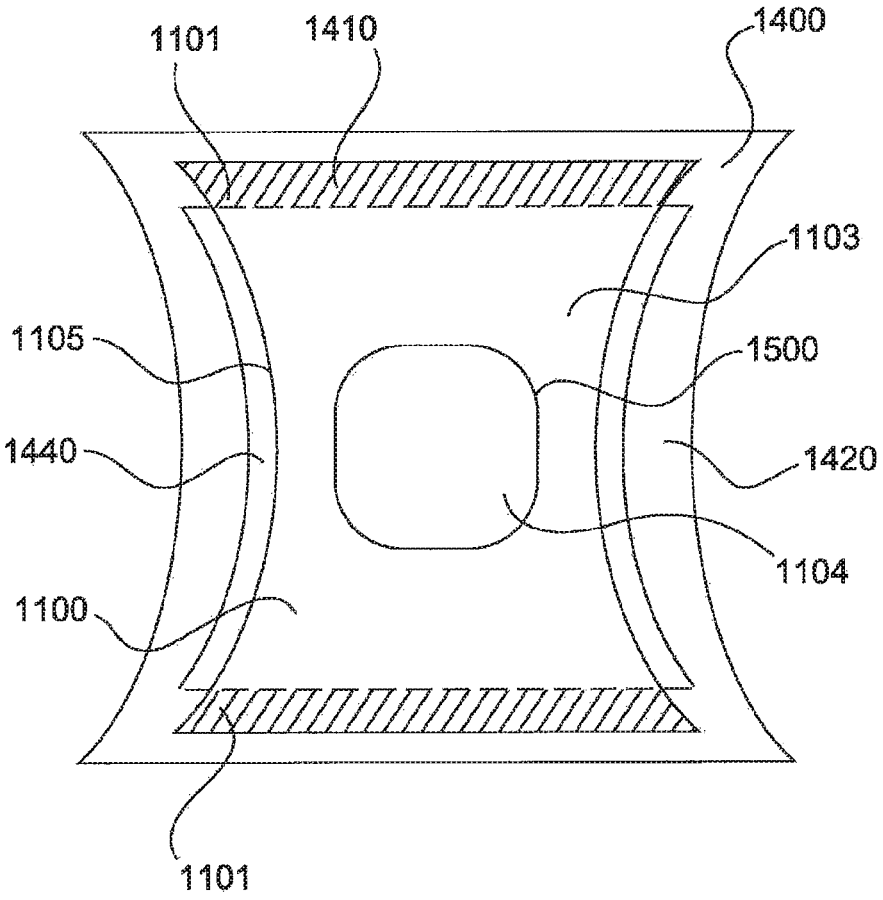
FIG. 5 shows a diagrammatic illustration of an electrodynamic sound transducer according to a fifth embodiment.

FIG. 5 shows a diagrammatic illustration of a plan view of an electrodynamic sound transducer, according to a fifth embodiment. In the fifth embodiment, the diaphragm 110 is not produced by cutting a conventional round diaphragm, but here a different configuration is involved. An annular coil 1500 is provided on the diaphragm 1100. The diaphragm 1100 is in the form of a dome 1104 in the interior of the coil 1500. The outside region is in the form of a bead 1103. The chassis 1400 is equipped with two oppositely disposed side walls 1420. At its edge 1101 the diaphragm 1100 is fixed to the chassis 1400 at two opposite ends 1410. Between the fixing ends 1410 and the two edges 1101 the diaphragm 1100 has at its edge two oppositely disposed edge portions 1105 at which it is not fixed to the chassis 1400 so that those portions 1105 can vibrate freely with respect to the chassis 1400. Provided between the edge portions 1105 and the side walls 1420 is a narrow gap whose width is less than 10% of the diameter of the coil 1500. The spacing of the two oppositely disposed fixing ends 1410 of the diaphragm is greater in every direction than the diameter of the coil 1500.

What is claimed is:

1. An electrodynamic sound transducer comprising a chassis, and a diaphragm having at least two fixing portions in the shape of a segment of a circle for fixing to the chassis and a central rectangular portion directly between the two fixing portions, wherein the two fixing portions in the shape of a segment of a circle are defined by one circle which has a diameter, a central point (M) and a circle-bisecting straight line, wherein the central portion has two straight lines arranged parallel to the circle-bisecting straight line, wherein the chassis has two fixing portions and two straight side walls and the chassis is adapted to the shape of the diaphragm in such a way that the diaphragm is fixed only at the fixing portions in the shape of a segment of a circle and the side walls of the chassis do not touch the diaphragm and project beyond the diaphragm so that the central portion of the diaphragm and the straight lines of the central portion can vibrate freely, wherein a gap is present between the side walls and the diaphragm, wherein the gap retains its size upon deflections which occur in operation, and wherein the diaphragm comprises an annular coil seat configured to receive an annular coil.

2. An electrodynamic sound transducer as set forth in claim 1 wherein a width of the rectangular portion is less than the diameter of the diaphragm.

3. An electroacoustic sound transducer as set forth in claim 1 comprising:

a vibrating coil fixed to the diaphragm so that the vibrating coil can vibrate together with the diaphragm.

4. An electrodynamic sound transducer as set forth in claim 1 wherein the diaphragm is of an at least portion-wise embossed configuration.

5. An electrodynamic sound transducer comprising:

a chassis, and at least one diaphragm which is capable of vibrating and which at its edge has two oppositely disposed fixing portions for fixing the diaphragm to the chassis and which has two opposite and freely vibrating edge portions between the two fixing portions, wherein the edge of the diaphragm between the fixing portions comprises two edge portions at which the diaphragm is not connected to the chassis so that the freely vibrating edge portions of the diaphragm can vibrate freely with respect to the chassis, wherein the chassis has two opposite side walls which are arranged along the freely vibrating edge portions and do not touch the diaphragm, wherein a gap is present between the side walls of the chassis and the freely vibrating edge portions of the diaphragm, wherein the side walls project beyond the diaphragm such that the gaps retain their sizes upon deflections which occur in operation and wherein the diaphragm comprises an annular coil seat configured to receive an annular coil.

6. An electrodynamic sound transducer as set forth in claim 5, further comprising an annular coil which is fixed to the diaphragm.

7. An electrodynamic sound transducer as set forth in claim 5 wherein the side walls correspond in their shape to the freely vibrating edge portions of the diaphragm.

8. An electrodynamic sound transducer as set forth in claim 6 wherein the diaphragm is in the form of a dome in the interior of the coil.

9. An electrodynamic sound transducer as set forth in claim 6 wherein the diaphragm is in the form of a bead in the outer region of the coil.

10. An electrodynamic sound transducer as set forth in claim 6 wherein the spacing of the two oppositely disposed fixing portions of the diaphragm is greater in any direction than the diameter of the coil.

11. An electrodynamic sound transducer as set forth in claim 6, wherein the gaps between the edge portions and the side walls has a width which is less than 10% of a diameter of the coil.

12. An earphone comprising an electrodynamic sound transducer as set forth in one of claims 1-3, 4-5, and 6-11.

13. A microphone comprising an electrodynamic sound transducer as set forth in one of claims 1-3, 4-5, and 6-11.

14. A method of manufacturing an electrodynamic sound transducer, comprising the steps of:

providing an annular diaphragm, which is defined by a central point and a diameter;

cutting away two portions of the diaphragm in the shape of a segment of a circle such that the diaphragm has two fixing portions in the shape of a segment of a circle configured to be fixed to a chassis and a central portion between the two fixing portions, wherein the central portion comprises two straight lines being parallel to a circle-bisecting line; and fixing the at least two fixing portions to a chassis in such a way that the diaphragm is fixed only at the fixing portions to the chassis and that the straight lines of the central portion can vibrate freely without being coupled to side walls of the chassis, wherein a gap is present between the side walls of the chassis and the straight lines of the central portion of the diaphragm, and wherein the gap retains its size upon deflection which occurs in operation.

* * * * *